US005531915A

United States Patent [19]

Perkins

[11] Patent Number: 5,531,915

[45] Date of Patent: Jul. 2, 1996

[54] DETERGENT COMPOSITIONS CONTAINING ETHYLENEDIAMINE-N,N'-DIGLUTARIC ACID OR 2-HYDROXYPROPYLENEDIAMINE-N,N'-DISUCCINIC ACID

[75] Inventor: Christopher M. Perkins, Cincinnati, Ohio

[73] Assignee: The Procter & Gamble Company, Ohio

[21] Appl. No.: 317,096

[22] Filed: Oct. 3, 1994

Related U.S. Application Data

[63] Continuation of Ser. No. 26,884, Mar. 5, 1993, abandoned.

[51] Int. Cl.[6] ..... C11D 3/386

[52] U.S. Cl. ..... 510/294; 252/549; 134/42; 510/300; 510/306; 510/310; 510/318; 510/321; 510/337; 510/352; 510/361; 510/373; 510/480; 510/434

[58] Field of Search ..... 252/546, 527, 252/95, 174.12, DIG. 12, 549; 134/42

[56] References Cited

U.S. PATENT DOCUMENTS

| | | | |
|---|---|---|---|
| 3,151,084 | 9/1964 | Schiltz et al. | 252/137 |
| 3,637,511 | 1/1972 | Yang et al. | 252/527 |
| 3,920,564 | 11/1975 | Grecsek | 252/8.75 |
| 4,397,776 | 8/1983 | Ward | 252/527 |
| 4,560,492 | 12/1985 | Curry et al. | 252/110 |
| 4,689,167 | 8/1987 | Collins et al. | 252/95 |
| 4,698,181 | 10/1987 | Lewis | 252/527 |
| 4,704,233 | 11/1987 | Hartman et al. | 252/527 |
| 4,827,014 | 5/1989 | Baur et al. | 558/441 |
| 4,968,443 | 11/1990 | Lambert et al. | 252/8.8 |
| 4,983,315 | 1/1991 | Glogowski et al. | 252/102 |
| 5,405,412 | 4/1995 | Willey et al. | 8/111 |
| 5,405,413 | 4/1995 | Willey et al. | 8/111 |

FOREIGN PATENT DOCUMENTS 2297903 9/1976 France .

OTHER PUBLICATIONS

CA77(2): 10322k Synthesis and Complexing Properties of Complexons, derivatives of dicarboxylic acids. I. Ethylenediamine–N,N'–diglutaric acid.
CA79(14):87160e; CA84(22):156369x; CA86(4):22474k; CA86(18):132853r; CA93(18):174573g; CA100(20):162602h.

*Primary Examiner*—Paul Lieberman
*Assistant Examiner*—Kery Fries
*Attorney, Agent, or Firm*—Jerry J. Yetter; Kim William Zerby; Brian M. Bolam

[57] ABSTRACT

Detergent compositions containing conventional detergent surfactants, detergent builders, and the like, and a chelant selected from ethylenediamine-N,N'-diglutaric acid (EDDG) and 2-hydroxypropylenediamine-N,N'-disuccinic acid (HPDDS) are disclosed. Such compositions provide enhanced removal of organic stains, such as food and beverage stains. The EDDG and HPDDS are biodegradable and contain no phorphorus.

11 Claims, No Drawings

DETERGENT COMPOSITIONS CONTAINING ETHYLENEDIAMINE-N,N'-DIGLUTARIC ACID OR 2-HYDROXYPROPYLENEDIAMINE-N,N'-DISUCCINIC ACID

This is a continuation of application Ser. No. 08/026,884, filed on Mar. 5, 1993 now abandoned.

TECHNICAL FIELD

The present invention relates to improved laundry detergent compositions. Specifically, it relates to laundry detergent compositions containing ethylenediamine-N,N'-diglutaric acid (EDDG) or 2-hydroxypropylenediamine-N,N'-disuccinic acid (HPDDS), which are nil-phosphorus, biodegradable chelants, to assist in the removal of food, beverage, and certain other organic stains, especially polyphenolic stains, from fabrics during the laundry process. EDDG and HPDDS can be used as a replacement for all or part of the non-biodegradable phosphonate chelants currently used in many existing laundry products, thereby yielding detergent formulations which have reduced phosphorus content and which have greater biodegradability than many of those currently in use. Moreover, the EDDG and HPDDS chelants provide good stain removal in detergents designed for hard surface cleaning.

BACKGROUND OF THE INVENTION

In some geographical areas there has been a growing concern regarding the use of phosphorus-containing compounds in laundry detergent compositions because of reported links of such compounds to the eutrophication of lakes and streams. While it is not clear whether or not this link is really significant, some governmental bodies have restricted the phosphorus content of detergent compositions, thereby necessitating the formulation of laundry detergents containing chelants which are less effective than the conventionally-used phosphonates or polyphosphonates. These requirements have complicated the formulation of effective and appropriately priced laundry detergent compositions. It would, therefore, be highly desirable to be able to formulate detergent compositions which include reduced levels of phosphorus-containing components and which are at least partially biodegradable, but which still exhibit excellent cleaning and stain removal performance.

In addition, while the use of chelants in detergent compositions is generally thought to be desirable for enhanced stain removal, there is generally believed to be an efficacy/biodegradability trade-off therewith. For example, some chelants which provide superior stain removal (e.g., diethylenetriaminepentaacetates) tend to be nonbiodegradable, while those which exhibit some level of biodegradability (e.g., N-(2-hydroxyethyl)aspartic acid) are relatively poor in terms of stain removal.

It is an object of the present invention to enhance the stain removal performance in detergent compositions, unlimited in type. It is a special object of the present invention to provide laundry detergent compositions containing nil-phosphorus, biodegradable chelants, that possess excellent stain removal characteristics.

BACKGROUND ART

The use of aminopolycarboxylates as laundry detergent additives is generally disclosed in the art. For example, the prior art describes laundry detergent compositions which include nitrilotriacetates (NTA), ethylenediaminetetraacetates (EDTA), diethylenetriaminepentaacetates (DTPA), hydroxyethylethylenediaminetriacetates (HEDTA), and triethylenetetraminehexaacetic acid (TTHA).

U.S. Pat. No. 4,704,233, Hartman and Perkins, discloses the use of ethylenediamine-N,N'-disuccinic acid in laundry detergents. See also U.S. Pat. No. 4,983,315, Glogowski et al, issued Jan. 8, 1991; U.S. Pat. No. 4,560,491, Curry and Edwards, issued Dec. 24, 1985; U.S. Pat. No. 4,397,776, Ward, issued Aug. 9, 1983; U.S. Pat. No. 3,920,564, Grecsek, issued Nov. 18, 1975; U.S. Pat. No. 3,151,084, Schiltz et al, issued Sep. 29, 1964 for disclosure of various detergent compositions containing materials such as NTA, DTPA and the like.

The synthesis of EDDG and its complexation with metal ions is disclosed in several references; see CA77(2):10322k; CA100(20):162 602h; CA93(18):174673g; and CA79(14):87160e.

HPDDS is disclosed in various references; see CA86(18):132853r; CA86(4):22474k; and CA84(22):156369x.

SUMMARY OF THE INVENTION

The present invention relates to detergent compositions comprising conventional detersive surfactants, optional builders and detersive adjuncts and from about 0.1% to about 20% by weight of a chelant which is a member selected from the group consisting of ethylenediamine-N,N'-diglutaric acid (EDDG) or salt thereof. 2-hydroxypropylenediamine-N,N'-disuccinic acid (HPDDS), or salt thereof, or mixtures of said chelants.

Typical compositions herein are those wherein the surfactant component is a member selected from the group consisting of alkylbenzene sulfonates, alkyl sulfates, alkyl polyethoxy sulfates, alkyl ethoxylates, alkylphenol ethoxylates, polyhydroxy fatty acid amides, alpha sulfonated fatty acid esters, amine oxides and mixtures thereof.

Built compositions herein typically contain detergency builders selected from the group consisting of zeolites; layered silicates; alkali metal silicates; alkali metal carbonates; alkali metal phosphates; alkali metal polyphosphates; alkali metal phosphonates; alkali metal polyphosphonic acids, $C_{10}$–$C_{18}$ alkyl monocarboxylic acids, polycarboxylic acids, and the alkali metal, ammonium or substituted ammonium salts thereof; and mixtures thereof.

Preferred compositions herein have the EDDG or HPDDS chelant in the form of the [S,S] isomer.

Fully-formulated detergents herein additionally contain detersive adjuncts such as bleaching agents, detersive enzymes, and the like. Preferred liquid laundry detergent compositions comprise water-soluble polycarboxylate builders, especially citrate and oxydisuccinate builders. Preferred granular compositions contain zeolite or layered silicate builders, or mixtures thereof, or mixtures with polycarboxylate builders. For regions where phosphate is acceptable, preferred bar compositions will comprise a phosphate builder.

The invention also encompasses a method for removing stains from surfaces, comprising contacting the stained surfaces with the EDDG or HPDDS, especially in detergent compositions according to this invention, in the presence of water. Typically, this method will be conducted with physical agitation of the composition at a concentration of at least 100 ppm, preferably at least 500 ppm of the finished detergent compositions, in water. If a liquid or bar composition is used, the liquid or bar can be rubbed directly onto the stain. If EDDG or HPDDS is used without the presence of surfactants and cleaning adjuncts, they will typically be at concentrations of at least 50 ppm, preferably 100 ppm, in water.

The preferred compositions of this invention are laundry detergents comprising a) from about 1% to about 75% by weight of a detersive surfactant selected from the group consisting of anionic surfactants, nonionic surfactants, zwitterionic surfactants, ampholytic surfactants, cationic surfactants, and mixtures thereof; b) from about 5% to about 80% by weight of a detergency builder; and c) from about 0.1% to about 10% by weight of a member selected from the group consisting of EDDG and HPDDS or alkali metal, alkaline earth, ammonium or substituted ammonium salts thereof, or mixtures thereof.

All percentages, ratios and proportions herein are by weight, unless otherwise specified.

DETAILED DESCRIPTION OF THE INVENTION

The components of the present invention are described in detail below.

The EDDG chelant used in the practice of this invention is also known as N-[2-[(1,3-dicarboxypropyl)amino]ethyl]-glutamic acid or N,N'-1,2-ethanediyl-bis-glutamic acid and has the formula:

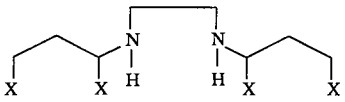

wherein X is carboxyl. EDDG exists as ]S,S], [R,S] and [R,R] isomers, all of which are biodegradable. This is an advantage for EDDG over many other amino chelants in which, typically, only one or two isomer forms are adequately degradable. The synthesis of EDDG can be carried out using 1-glutamic acid (which is readily available from the food industry as monosodium glutamate) and dibromoethane, according to the following reaction.

$$\text{2 d,l glutamic acid + dibromoethane} \xrightarrow[\text{H}_2\text{O/ethanol}]{\text{heat/base}}$$

EDDG(isomer mixture)

To produce to [S,S] form, the 1-isomer of the glutamic acid reactant is used.

The HPDDS chelant used in the practice of this invention is also known as N-[3-[(1,2-dicarboxyethyl)amino]2-hydroxypropyl]aspartic acid or N,N'-1,3-(2-hydroxy)propanediyl-bis-aspartic acid and has the formula:

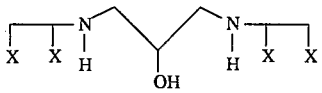

wherein X is carboxyl. HPDDS exists as [S,S], [R,R] and [R,S] isomers, of which the [S,S] has now been found to be the most biodegradable. The synthesis of the isomer mixture of HPDDS can be carried out using maleic acid and 1,3-diamino-2-propanol, according to the following reaction.

$$\text{2 maleic acid + 1,3-diamino-2-propanol} \xrightarrow[\text{H}_2\text{O}]{\text{heat/base}}$$

-continued

HPDDS(isomer mixture)

The [S,S] form can be synthesized using 1-aspartic acid (which is readily available from the food industry as a raw material used for the manufacture of the sweetener sold under the trademark ASPARTAME) and a reactant selected from materials such as epichlorohydrin or 1,3-dichloro-2-propanol or 1,3-dibromo-2-propanol, as follows:

$$\text{2 l-aspartic acid + reactant} \xrightarrow[\text{H}_2\text{O}]{\text{heat/base}}$$

[S, S] — HPDDS

The EDDG and HPDDS materials herein can be used in their acid, alkali metal, alkaline earth metal, ammonium, alkanolammonium, and the like, salt forms, according to the desires of the formulator.

It has now been determined that the EDDG and HPDDS chelants provide additional cleaning benefits when added to conventional laundry detergent compositions, especially with regard to the removal of stains such as grape juice and tea from fabrics.

It has now also been determined that EDDG and HPDDS exhibit the ability to stabilize peracid bleaches in laundering compositions under high stress conditions, e.g., at wash temperatures of about 60° C. in the presence of heavy metal ions such as iron, copper and manganese. In this regard, the HPDDS provides somewhat more bleach stabilization than EDDG.

With regard to biodegradability, the isomer mixture of EDDG is rapidly and completely biodegradable in unacclimated testing. The isomer mixture of HPDDS is 25% mineralized in unacclimated testing, and it is judged likely that this is due to complete biodegradation of the [S,S]-HPDDS isomer.

One advantage of the EDDG and HPDDS chelants herein is that they are compatible and usable with otherwise conventional detersive adjuncts. Nonlimiting examples of such detersive adjuncts are as follows.

Detersive Surfactants

The compositions herein can contain various anionic, nonionic, zwitterionic, etc. surfactants. Such surfactants are typically present at levels of from about 5% to about 80% by weight of the compositions. Nonlimiting examples of surfactants useful herein include the conventional $C_{11}$–$C_{18}$ alkyl benzene sulfonates and primary and random alkyl sulfates, the $C_{10}$–$C_{18}$ alkyl alkoxy sulfates (especially EO 1–5 ethoxy sulfates), the $C_{10}$–$C_{18}$ alkyl alkoxy carboxylates (especially EO 1–5 ethoxy carboxylates), the $C_{10}$–$C_{18}$ alkyl polyglycosides and their corresponding sulfated polyglycosides, $C_{12}$–$C_{18}$ alpha-sulfonated fatty acid esters, $C_{12}$–$C_{18}$ alkyl and alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like. Other conventional useful surfactants are listed in standard texts.

One particular class of nonionic surfactants especially useful herein comprises the polyhydroxy fatty acid amides of the formula:

$$R^2-\overset{\overset{\displaystyle O}{\|}}{C}-\overset{\overset{\displaystyle R^1}{|}}{N}-Z \qquad \text{(I)}$$

wherein: $R^1$ is H, $C_1$–$C_8$ hydrocarbyl, 2-hydroxyethyl, 2-hydroxypropyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{32}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{19}$ alkyl or alkenyl, or mixture thereof; and Z is a polyhydroxyhydrocarbyl moiety having a linear hydrocarbyl chain with at least 2 (in the case of glyceraldehyde) or at least 3 hydroxyls (in the case of other reducing sugars) directly connected to the chain, or an alkoxylated derivative (preferably ethoxylated or propoxylated) thereof. Z preferably will be derived from a reducing sugar in a reductive amination reaction; more preferably Z is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 1 to 5, inclusive, and R' is H or a cyclic mono- or poly-saccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-isobutyl, N-2-hydroxy ethyl, or N-2-hydroxy propyl. For highest sudsing, $R^1$ is preferably methyl or hydroxyalkyl. If low sudsing is desired, $R^1$ is preferably $C_2$–$C_8$ alkyl, especially n-propyl, iso-propyl, n-butyl, iso-butyl, pentyl, hexyl and 2-ethyl hexyl.

$R^2—CO—N<$ can be, for example, cocamide, stearamide, oleamide, lauramide, myristamide, capricamide, palmitamide, tallowamide, etc.

While polyhydroxy fatty acid amides can be made by the process of Schwartz, U.S. Pat. No. 2,703,798, contamination with cyclized by-products and other colored materials can be problematic. As an overall proposition, the preparative methods described in WO-9,206,154 and WO-9,206,984 will afford high quality polyhydroxy fatty acid amides. The methods comprise reacting N-alkylamino polyols with, preferably, fatty acid methyl esters in a solvent using an alkoxide catalyst at temperatures of about 85° C. to provide high yields (90–98%) of polyhydroxy fatty acid amides having desirable low levels (typically, less than about 1.0%) of sub-optimally degradable cyclized by-products and also with improved color and improved color stability, e.g., Gardner Colors below about 4, preferably between 0 and 2. (With compounds such as butyl, iso-butyl and n-hexyl, the methanol introduced via the catalyst or generated during the reaction provides sufficient fluidization that the use of additional reaction solvent may be optional.) If desired, any unreacted N-alkylamino polyol remaining in the product can be acylated with an acid anhydride, e.g., acetic anhydride, maleic anhydride, or the like, to minimize the overall level of such residual amines in the product. Residual sources of classical fatty acids, which can suppress suds, can be depleted by reaction with, for example, triethanolamine.

By "cyclized by-products" herein is meant the undesirable reaction by-products of the primary reaction wherein it appears that the multiple hydroxyl groups in the polyhydroxy fatty acid amides can form ring structures which are, in the main, not readily biodegradable. It will be appreciated by those skilled in the chemical arts that the preparation of the polyhydroxy fatty acid amides herein using the di- and higher saccharides such as maltose will result in the formation of polyhydroxy fatty acid amides wherein linear substituent Z (which contains multiple hydroxy substituents) is naturally "capped" by a polyhydroxy ring structure. Such material s are not cyclized by-products, as defined herein.

The foregoing polyhydroxy fatty acid amides can also be sulfated, e.g., by reaction with $SO_3$/pyridine, and the resulting sulfated material used as an anionic surfactant herein.

Builders

Detergent builders can optionally, but preferably, be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 1% builder. Granular formulations typically comprise from about 10% to about 80%, more typically from about 15% to about 50% by weight, of the detergent builder. Lower or higher levels of builder, however, are not meant to be excluded.

Inorganic detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders. Moreover, the secondary (2,3) alkyl sulfate plus enzyme components perform best in the presence of weak, nonphosphate builders which allow free calcium ions to be present.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. However, other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are especially useful in the present invention. Aluminosilicate builders are of great importance in most currently marketed heavy duty granular detergent compositions. Aluminosilicate builders include those having the empirical formula:

$$M_z(zAlO_2 \cdot ySiO_2)$$

wherein M is sodium, potassium, ammonium or substituted ammonium, z is from about 0.5 to about 2; and y is 1; this material having a magnesium ion exchange capacity of at least about 50 milligram equivalents of $CaCO_3$ hardness per gram of anhydrous aluminosilicate. Preferred aluminosilicates are zeolite builders which have the formula:

$$Na_z[(AlO_2)_z(SiO_2)_y]\cdot xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), and Zeolite X. In an especially preferred embodiment, the crystalline aluminosilicate ion exchange material has the formula:

$$Na_{12}[(AlO_2)_{12}(SiO_2)_{12}]\cdot xH_2O$$

wherein x is from about 20 to about 30, especially about 27. This material is known as Zeolite A. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Adjunct Ingredients

The detergent compositions herein will also typically comprise various adjunct ingredients. Nonlimiting examples of such ingredients are as follows.

Enzymes—Detersive enzymes can be included in the detergent formulations herein for a wide variety of fabric laundering purposes, including removal of protein-based, carbohydrate-based, or triglyceride-based stains, for example, and for the prevention of fugitive dye transfer. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1%, by weight of a commercial enzyme preparation. Protease enzymes are usually present in such commercial preparations at levels sufficient to provide from 0.005 to 0.1Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Ser. No. 87303761.8, filed Apr. 28, 1987, and European Patent Application 330,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL, Novo Industries.

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247,832.

Suitable lipase enzymes for detergent usage include those produced by microorganisms of the Pseudomonas group, such as *Pseudomonas stutzeri* ATCC 19.154, as disclosed in British Patent 1,372,034. See also lipases in Japanese Patent Application 53-20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum,* e.g. *Chromobacter viscosum* var. lipolyticum NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli.* The LIPOLASE enzyme derived from *Humicola lanuginosa* and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent granules is also disclosed in U.S. Pat. No. 3,553,139, issued Jan. 5, 1971 to McCarty et al (). Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 4,261,868, issued Apr. 14, 1981 to Horn, et al, U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. Nos. 4,261,868, 3,600,319, and 3,519,570.

Enzyme Stabilizers—The enzymes employed herein are stabilized by the presence of water-soluble sources of calcium ions in the finished compositions which provide calcium ions to the enzymes. Additional stability can be provided by the presence of various other art-disclosed stabilizers, especially borate species: see Severson, U.S. Pat. No. 4,537,706, cited above. Typical detergents will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium ions. The level of calcium ion should be selected so that there is always some minimum level available for the enzyme, after allowing for complexation with builders, fatty acids, etc., in the composition. Any water-soluble calcium salt can be used as the source of calcium ion, including, but not limited to, calcium chloride, calcium sulfate, calcium malate, calcium hydroxide, calcium formate, and calcium acetate. A small amount of calcium ion, generally from about 0.05 to about 0.4 millimoles per liter, is often also present in the composition due to calcium in the enzyme slurry and formula water. Solid detergent compositions according to the present invention may include a sufficient quantity of a water-soluble calcium ion source to provide such amounts in the laundry liquor. In the alternative, natural water hardness may suffice.

It is to be understood that the foregoing levels of calcium ions are sufficient to provide enzyme stability. More calcium ions can be added to the compositions to provide an additional measure of grease removal performance. Accordingly, the compositions herein may comprise from about 0.2% to about 2% by weight of a water-soluble source of calcium ions. The amount can vary, of course, with the amount and type of enzyme employed in the composition.

The compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

In addition to enzymes, the compositions herein can optionally include one or more other detergent adjunct materials or other materials for assisting or enhancing cleaning performance, treatment of the substrate to be cleaned, or to modify the aesthetics of the detergent composition (e.g., perfumes, colorants, dyes, etc.). The following are illustrative examples of such adjunct materials.

Bleaching Compounds—Bleaching Agents and Bleach Activators

The detergent compositions herein may optionally contain bleaching agents or bleaching compositions containing a bleaching agent and one or more bleach activators. When present, bleaching agents will typically be at levels of from about 1% to about 30%, more typically from about 1% to about 10%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetra-hydrate) can be used herein.

One category of bleaching agent that can be used without restriction encompasses percarboxylic acid bleaching agents and salts thereof. Suitable examples of this class of agents include magnesium monoperoxyphthalate hexahydrate, the magnesium salt of meta-chloro perbenzoic acid, 4-nonyl amino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

Mixtures of bleaching agents can also be used.

Peroxygen bleaching agents, the perborates, the percarbonates, etc. are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Bleaching agents other than oxygen bleaching agents are also known in the art and can be utilized herein. One type of nonoxygen bleaching agent of particular interest includes, photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain about 0.025% to about 1.25%, by weight, of such bleaches, especially sulfonated zinc phthalocyanine.

Polymeric Soil Release Agent—Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably poly(vinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from 2 to about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly(vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units containing 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink.

Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoaroyl, end-capped terephthalate esters.

If utilized, soil release agents will generally comprise from about 0.01% to about 10.0%, by weight, of the detergent compositions herein, typically from about 0.1% to about 5%, preferably from about 0.2% to about 3.0%.

Clay Soil Removal/Anti-redeposition Agents—The compositions of the present invention can also optionally contain water-soluble ethoxylated amines having clay soil removal and anti-redeposition properties. Granular detergent compositions which contain these compounds typically contain from about 0.01% to about 10.0% by weight of the water-soluble ethoxylated amines.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal/antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. Another type of preferred anti redeposition agent includes the carboxy methyl cellulose (CMC) materials. These materials are well known in the art.

Polymeric Dispersing Agents—Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982.

Another polymeric material which can be included is polyethylene glycol (PEG). PEG can exhibit dispersing agent performance as well as act as a clay soil removal/antiredepositior, agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders.

Brightener—Any optical brighteners or other brightening or whitening agents known in the art can be incorporated at levels typically from about 0.05% to about 1.2%, by weight, into the detergent compositions herein. Commercial optical brighteners which may be useful in the present invention can be classified into subgroups which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production an Application of Fluorescent Brightening Agents", M. Zahradnik Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Arctic White CC and Artic White CWD, available from Hilton-Davis, located in Italy; the 2-(4-styryl-phenyl)-2H- naphthol[1,2-d]triazoles; 4,4'-bis- (1,2,3-triazol-2-yl)-stil- benes; 4,4'-bis-(styryl)bisphenyls; and the y-aminocoumarins. Specific examples of these brighteners include 4-methyl-7-diethyl- amino coumarin; 1,2-bis(-benzimidazol-2-yl)ethylene; 1,3-diphenylphrazolines; 2,5-bis(benzoxazol-2-yl)thiophene; 2-styryl-naphth-[1,2-d]oxazole; and 2-(stilbene-4-yl)-2H-naphtho- [1,2-d] triazole. See also U.S. Pat. No. 3,646,015, issued Feb. 29, 1972 to Hamilton.

Suds Suppressors—Compounds for reducing or suppressing the formation of suds can be incorporated into the compositions of the present invention. Suds suppression can be of particular importance under conditions such as those found in European-style front loading laundry washing machines, or in the concentrated detergency process of U.S. Pat. Nos. 4,489,455 and 4,489,574, or when the detergent compositions herein optionally include a relatively high sudsing adjunct surfactant.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acids and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g. stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g. K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about −40° C. and about 5° C., and a minimum boiling point not less than about 110° C. (atmospheric pressure). It is also known to utilize waxy hydrocarbons, preferrably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed of fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

An exemplary silicone based suds suppressor for use herein is a suds suppressing amount of a suds controlling agent consisting essentially of:

(i) polydimethylsiloxane fluid having a viscosity of from about 20 cs. to about 1500 cs. at 25° C.;

(ii) from about 5 to about 50 parts per 100 parts by weight of (i) of siloxane resin composed of $(CH_3)_3\ SiO_{1/2}$ units of $SiO_2$ units in a ratio of from $(CH_3)_3\ SiO_{1/2}$ units and to $SiO_2$ units of from about 0.6:1 to about 1.2:1; and (iii) from about 1 to about 20 parts per 100 parts by weight of (i) of a solid silica gel;

In the preferred silicone suds suppressor used herein, the solvent for a continuous phase is made up of certain polyethylene glycols or polyethylene-polypropylene glycol copolymers or mixtures thereof (preferred), and not polypropylene glycol. The primary silicone suds suppressor is branched/crosslinked ,and not linear.

To illustrate this point further, typical laundry detergent compositions with controlled suds will optionally comprise from about 0.001 to about 1, preferably from about 0.01 to about 0.7, most preferably from abut 0.05 to about 0.5, weight % of said silicone suds suppressor, which comprises (1) a nonaqueous emulsion of a primary antifoam agent which is a mixture of: (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. Similar amounts can be used in granular compositions, gels, etc. See also U.S. Pat. Nos. 4,978,471, Starch, issued Dec. 18, 1990, and 4,983,316, Starch, issued Jan. 8, 1991, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount." By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to about 5% of suds suppressor. When utilized as suds suppressors, monocarboxylic fatty acids, and salts therein, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

In addition to the foregoing ingredients, the surfactant compositions herein can also be used with a variety of other adjunct ingredients which provide still other benefits in various compositions within the scope of this invention. The following illustrates a variety of such adjunct ingredients, but is not intended to be limiting therein.

Fabric Softeners—Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners, as disclosed, for example, in U.S. Pat. No. 4,375,416, Crisp et al, Mar. 1, 1983 and U.S. Pat. No. 4,291,071, Harris et al, issued Sep. 22, 1981.

Other Ingredients—A wide variety of other ingredients useful in detergent compositions can be included in the compositions herein, including other active ingredients, carriers, processing aids, dyes or pigments. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, typically, 0.1%–2%, to provide additional sudsing.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol EO(7) nonionic surfactant. Typically, the enzyme/surfactant solution is 2.5 X the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents.

The fully-formulated detergent compositions herein will preferably be prepared such that, during use in aqueous cleaning operations, the wash water will have a pH of between about 6.5 and about 11, preferably between about 7.5 and about 10.5. Techniques for controlling pH at recommended usage levels include the use of buffers, alkalis, acids, etc., and are well known to those skilled in the art. Usage levels of the compositions typically range from 100 ppm to 5,000 ppm in an aqueous wash liquor.

The following are nonlimiting examples of compositions according to this invention.

EXAMPLE 1

Heavy duty, granular detergent compositions are prepared by spray drying a water slurry of the following components, listed in the stated proportions (by weight after spray drying).

| | A | B |
|---|---|---|
| $C_{13}$ linear alkylbenzene sulfonate, Na | 8.75% | 10.0% |
| $C_{14}$–$C_{15}$ alkyl sulfate, Na | 8.75 | — |
| $C_{14}$–$C_{16}$ alkyl sulfate, Na | — | 10.0 |
| Topped $C_{12}$–$C_{13}$ alkyl ethoxylate (6.5) | 0.5 | 1.2 |
| Sodium tripolyphosphate | 38.2 | — |
| Aluminosilicate (Zeolite A) | — | 11.7 |
| EDDG (Na salt) | 3.0 | 3.0 |
| Sodium carbonate | 15.8 | 17.5 |
| Silicate ($SiO_2/Na_2O$ ratio = 1.6 to 1) | 5.3 | — |
| Sodium sulfate | 12.1 | 40.0 |
| Polyethylene glycol (MW = 8000) | 0.5 | 1.2 |
| Polyacrylate (MW = 1500) | 1.0 | 3.5 |
| Water, perfume, colorants, fabric whiteners, bleaching agents, and other miscellaneous ingredients | Balance | Balance |

The compositions of Example I, when used to launder fabrics, provide excellent stain removal and cleaning performance.

EXAMPLE II

The compositions of Example I are modified by replacing the EDDG with an equivalent amount of HPDDS.

EXAMPLE III

Heavy duty, nil phosphorus, liquid detergent compositions are prepared by adding the components together in the stated proportions with continuous mixing and adjustment of the pH to about 8–9.5 through the addition of NaOH or KOH.

| | A | B |
|---|---|---|
| $C_{12}$ linear alkylbenzene sulfonic acid, Na | — | 10.25% |
| $C_{13}$ linear alkylbenzene sulfonic acid, Na | 8.0% | — |
| $C_{14}$–$C_{15}$ alkyl ethoxylate-2.25 sulfuric acid, Na | 12.0 | — |
| $C_{12-14}$ alkyl N-methyl glucose amide | 5.0 | 11.0 |
| Coconut alkyl sulfate | — | 3.88 |
| $C_{12}$–$C_{14}$ fatty acid | 10.5 | — |
| Citric acid | 3.25 | 0.9 |
| Oleic acid | — | 3.88 |
| Coconut/palm kernel fatty acid | — | 10.68 |
| EDDG, Na | 2.25 | 1.7 |
| Water | 27.3 | 38.4 |
| Ethanol | 9.0 | 5.81 |
| 1,2-propanediol | 7.0 | 1.6 |
| KOH | 3.8 | — |
| NaOH | 3.0 | 3.4 |
| Triethanolamine | — | 4.85 |
| Monoethanolamine | 0.5 | — |
| Ethoxylated tetraethylenepentamine | 2.0 | — |
| Soil release polymer* | 2.5 | — |
| Perfume, colorants, enzymes, fabric whiteners, bleaching agents, and other miscellaneous ingredients | Balance | Balance |

*Anionic polyester

The compositions of Example III, when used to launder fabrics, provide excellent stain removal and cleaning performance.

EXAMPLE IV

The compositions of Example III are modified by replacing the EDDG with an equivalent amount of HPDDS.

EXAMPLE V

A laundry bar suitable for hand-washing soiled fabrics is prepared using standard extrusion processes to provide a bar comprising: $C_{12}$–$C_{13}$ alkyl benzene sulfonate (20%); sodium tripolyphosphate (20%); sodium silicate (7%); HDGG or HPDDS according to the desires of the formulator (10%); sodium carbonate (8%); fillers such as talc or magnesium sulfate (25%); water (5%); and minors (balance).

The HDGG and HPDDS chelants herein are also suitable for use for stain removal and bleach stabilization in automatic dishwashing compositions and hard surface cleansers. Typical examples of such compositions are as follows.

EXAMPLE VI

An ADD composition whose compactness is 50% that of conventional ADD compositions (i.e., 50% reduction in usage levels) is as follows. The composition is designed for use at about 19.5 g per wash cycle (3,000 ppm in wash water).

| Ingredient | % (wt.) |
|---|---|
| Trisodium citrate[1] | 15 |
| Sodium carbonate (anhydrous basis) | 20 |
| Silicate (2.0 ratio)[2] | 21.4 |
| Nonionic surfactant[3] | 3.5 |
| Sodium polyacrylate (m.w. 4,000)[4] | 5.3 |
| EDDG, Na salt | 2.5 |
| OXONE (% Av 0) bleach | 20.7(0.95) |
| TERMAMYL 60 T prill | 1.1 |
| SAVINASE 6.0 T prill | 3.0 |
| $H_2O$/minors[5] | Balance |

[1]Trisodium citrate dihydrate, expressed on anhydrous basis.
[2]BRITESIL H2O, PQ Corp., expressed on anhydrous basis.
[3]$C_{18}E_{7.9}$ blend with block polyethyleneoxide/polypropyleneoxide copolymer; low/nil sudsing.
[4]ACCUSOL, Rohm & Haas.
[5]Maximum 8.5% wt. $H_2O$ in composition.

EXAMPLE VII (A, B, C)

Thickened liquid bleach-containing cleansers for bathrooms, kitchens and other hard surfaces are as follows.

| | % (wt.) | | |
|---|---|---|---|
| Ingredient | A | B | C |
| Hypochlorite | 1.0 | 2.0 | 2.0 |
| $C_{12}$ dimethyl amine oxide | 1.0 | 1.0 | 1.0 |
| Octyl sulfate (Na) | 4.0 | 8.0 | 4.0 |
| Polyacrylate thickener* | 1.5 | 1.5 | 1.5 |
| Sodium benzoate | 0.5 | 0.5 | 0.5 |
| Perfume | 0.2 | 0.2 | 0.2 |
| EDGG, Na | 3.0 | 3.5 | 5.0 |
| HPDDS, Na | 2.0 | 1.0 | 2.0 |
| Dye | 0.006 | 0.006 | 0.006 |
| NaOH (to product pH 12–13) | 1.2 | 1.2 | 1.0 |
| Deionized water | | Balance | |

*As POLYGEL DK.

EXAMPLE VIII

In Examples VI and VII the EDGG can be replaced by an equivalent amount of HPDDS.

The EDDG and HPDDS can be used in a variety of other compositions wherein a "chelant-type" of cleansing is useful. Thus, dentures (and teeth) stained with polyphenolic stains such as tobacco stains or food stains, e.g., tea, can be cleansed by contact with the EDDG or HPDDS in an aqueous medium. Thus, EDDG or HPDDS can be included in typical denture cleanser or dentifrice formulations.

The chelants herein, especially EDDG (typically 0.1%–2% by weight) can be used to reduce $H_2O_2$ decomposition in aqueous bleaches. Moreover, such compositions enjoy a thickening effect due to the presence of the EDDG, which allows the formulator to reduce surfactant levels, for a net cost savings. Thus, the invention herein provides a method for stabilizing aqueous bleaches, especially peroxide bleaches, typically comprising at least about 0.1% peroxide, by incorporating therein at least 0.1% by weight of EDDG or HPDDS, or salts or mixtures thereof.

In all the foregoing disclosure and examples, substantially equivalent results are secured with the potassium, ammonium, magnesium and triethanolammonium salts, respectively, of EDDG and HDGG are used in place of the sodium salts.

What is claimed is:

1. A detergent composition comprising from about 1% to about 75% by weight of detersive surfactants and from about 0.1% to about 20% by weight of a biodegradable chelant which is a member selected from the group consisting of ethylenediamine-N-N'-diglutaric acid (EDDG) or salt thereof, 2-hydroxypropylenediamine-N,N'-disuccininc acid (HPDDS), or salt thereof, or mixtures of said chelants, and 1 to 80% of a builder component.

2. A composition according to claim 1 wherein the surfactant component is a member selected from the group consisting of alkylbenzene sulfonates, alkyl sulfates, alkyl polyethoxy sulfates, alkyl ethoxylates, alkylphenol ethoxylates, polyhydroxy fatty acid amides, alpha sulfonated fatty acid esters, amine oxides and mixtures thereof.

3. A composition according to claim 1 wherein the detergency builder component is selected from the group consisting of zeolites; layered silicates; alkali metal silicates; alkali metal carbonates; alkali metal phosphates; alkali metal polyphosphates; alkali metal phosphonates; alkali metal polyphosphonic acids, $C_{10}$–$C_{18}$ alkyl monocarboxylic acids, polycarboxylic acids, and the alkali metal, ammonium or substituted ammonium salts thereof; and mixtures thereof.

4. A composition according to claim 1 wherein the EDDG or HPDDS is in the form of the isomer.

5. A laundry detergent according to claim 1 which additionally contains a bleaching agent.

6. A laundry detergent according to claim 1 which additionally contains an enzyme.

7. A liquid laundry detergent according to claim 1 further comprising a polycarboxylate builder.

8. A granular laundry detergent according to claim 1 further comprising a builder selected from zeolite or layered silicate builder, or mixtures thereof.

9. A bar composition according to claim 1 further comprising a phosphate builder.

10. A method for removing stains from fabrics and hard surfaces, comprising contacting the stained fabric or hard surface with a composition containing 1 to 20% of a biodegradable compound selected from ethylenediamine-N,N'-diglutaric acid or 2-hydroxypropylenediamine-N,N'-disuccinic acid, or salts or mixtures thereof in the presence of water and 1% to 75% by weight of a detersive surfactant.

11. A method for stabilizing bleaches by incorporating therein at least about 0.1% by weight of a biodegradable compound selected from ethylenediamine-N,N'-diglutaric acid or 2-hydroxypropylenediamine-N,N'-disuccinic acid, or salts or mixtures thereof.

* * * * *